US005542922A

United States Patent [19]

Petterson et al.

[11] Patent Number: 5,542,922

[45] Date of Patent: Aug. 6, 1996

[54] SYSTEM AND METHOD FOR DISPENSING LIQUID MEDICAMENTS TO INFANTS

[75] Inventors: Grace C. Petterson, Rancho Palos Verdes; Steven B. Dunn, Beverly Hills; Tor Petterson, Rancho Palos Verdes, all of Calif.

[73] Assignee: Munchkin, Inc., Van Nuys, Calif.

[21] Appl. No.: 334,590

[22] Filed: Nov. 4, 1994

[51] Int. Cl.[6] ..... A61J 7/00

[52] U.S. Cl. ..... 604/77; 604/78; 215/11.1; 606/236

[58] Field of Search ..... 119/71; 604/77, 604/78, 212; 606/234–236; 215/11.1, 227, 230, DIG. 3, DIG. 7

[56] References Cited

U.S. PATENT DOCUMENTS

| | | | |
|---|---|---|---|
| 1,672,466 | 6/1928 | Oshman et al. | 215/11.1 OR |
| 1,672,467 | 6/1928 | Oshmon et al. | 215/11.1 OR |
| 2,612,165 | 9/1952 | Szuderski | 128/360 |
| 2,796,062 | 6/1957 | Tupper | 215/11.1 X |
| 2,824,561 | 2/1958 | Mueller | 128/252 |
| 2,889,829 | 6/1959 | Tannenbaum et al. | 128/252 |
| 3,645,413 | 2/1972 | Mitchell | 215/11 R |
| 3,747,414 | 7/1973 | Ohno | 73/428 |
| 3,747,791 | 7/1973 | Fouser | 215/11.1 OR |
| 4,078,566 | 3/1978 | Urban, Jr. | 128/252 |
| 4,192,307 | 3/1980 | Baer | 128/252 |
| 4,493,348 | 1/1985 | Lemmons | 141/1 |
| 4,821,895 | 4/1989 | Roskilly | 215/11.1 |
| 4,915,242 | 4/1990 | Marte | 604/77 X |
| 5,029,701 | 7/1991 | Roth et al. | 206/232 |
| 5,078,734 | 1/1992 | Noble | 606/236 |
| 5,129,532 | 7/1992 | Martin | 215/11.1 |
| 5,269,425 | 12/1993 | Gomez-Acevedo | 215/11.1 |
| 5,419,445 | 5/1995 | Kaesemeyer | 215/11.1 OR |

FOREIGN PATENT DOCUMENTS

| | | | |
|---|---|---|---|
| 962002 | 6/1964 | United Kingdom . | |
| 2246555 | 2/1992 | United Kingdom | 604/77 |

*Primary Examiner*—Corrine M. McDermott
*Assistant Examiner*—N. Kent Gring
*Attorney, Agent, or Firm*—Woodcock Washburn Kurtz Mackiewicz & Norris

[57] ABSTRACT

A system for dispensing liquid medicine to an infant includes a baby bottle having a threaded neck portion at an upper end thereof and a rim that defines an opening; a resilient nipple member; and a ring member for holding the nipple member tightly against the rim during feedings. The ring member has threads defined in an interior portion thereof that mate with the threaded neck portion, whereby the ring member may be screwed onto the bottle. A medicine cup that includes a concave cup-like portion is sized to fit within the threaded neck portion of the baby bottle. The medicine cup further includes a flange for supporting the medicine cup on the rim of the baby bottle which is sized so as not to interfere with said ring member during screwing and unscrewing of the ring member onto the baby bottle. The cup-like portion is constructed so as to be impervious to fluid transfer therethrough, so medicine will not leak from the medicine cup into the baby bottle. Also disclosed is a method of dispensing medicament to an infant by filling the medicine cup with medicine, setting the medicine cup into the threaded neck portion of the baby bottle, and screwing the ring member, together with the nipple member, onto the threaded neck portion so as to seal said nipple member into communication with said medicine cup and out of communication with the rest of said baby bottle.

6 Claims, 1 Drawing Sheet

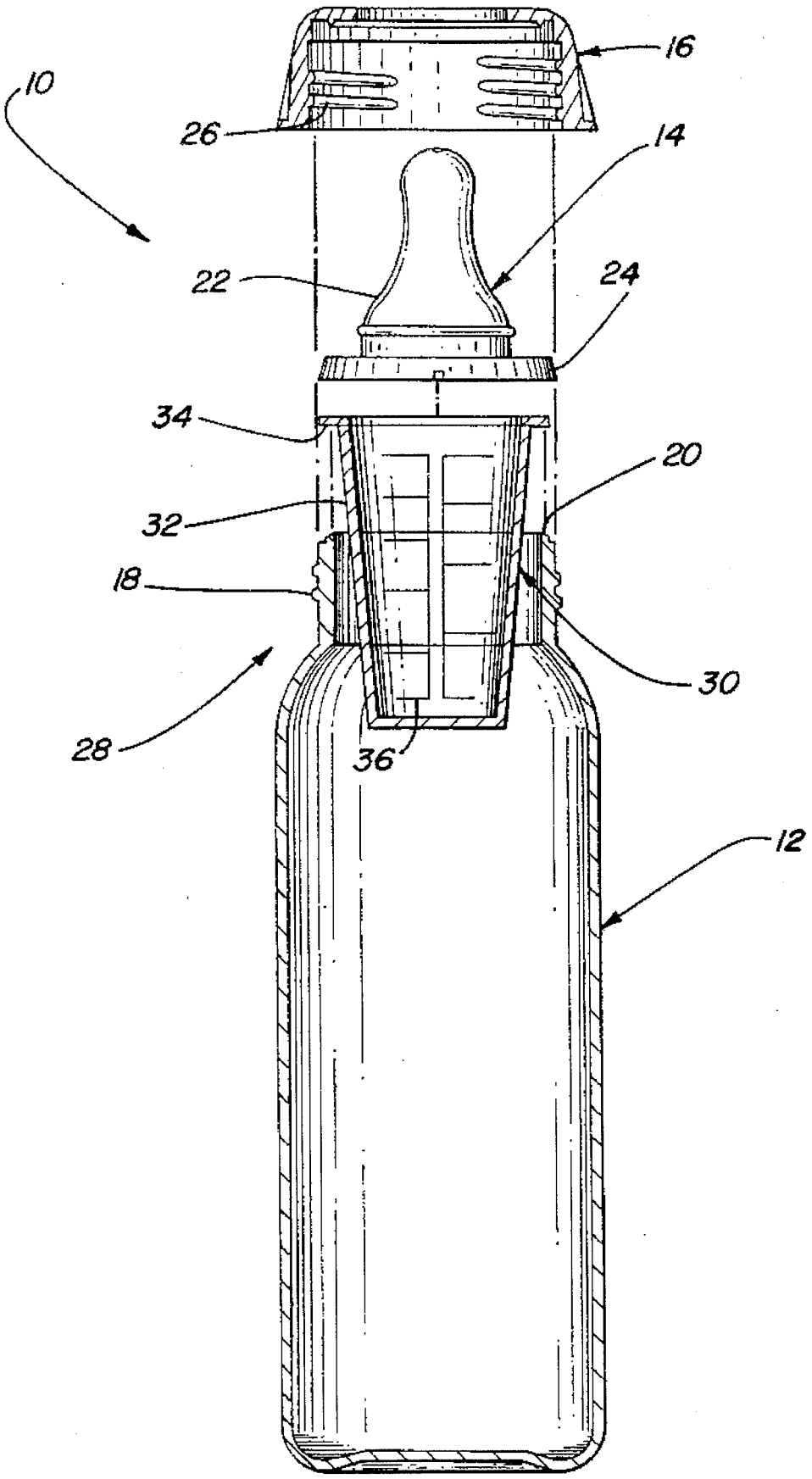
10
16
26
14
22
24
34
20
32
18
30
28
36
12

SYSTEM AND METHOD FOR DISPENSING LIQUID MEDICAMENTS TO INFANTS

BACKGROUND OF THE INVENTION

1. Field of the Invention

This invention relates broadly to the field of infant care and feeding. Specifically, this invention relates to an improved system and method for dispensing liquid medicaments to infants that is effective, accurate, inexpensive and compatible with most of the baby bottles that are commercially available today.

2. Description of the Prior Art

The administration of medicines to unwilling patients and particularly to infants and young children is a notoriously difficult task.

The problem is that many medicinal preparations are not palatable, in particular for small babies who have not tasted anything other then milk. Having a new taste is an unprecedented and extraordinary experience and even new foods have to be introduced gradually.

One way of introducing new foods is to mix a small amount of a new food with a known food, for example milk. Medicines may also be administered in this way, and are often added to a bottle containing the infant's usual milk-feed or some other liquid with which the infant is already familiar. Known mechanisms for accomplishing this are disclosed in U.S. Pat. Nos. 4,821,895 to Roskilly, 3,645,413 to Mitchell, 4,078,566 to Urban, and 5,029,701 to Roth et al.

The Mitchell patent involves a specialized medicine dispenser that includes a very small bottle having a capacity of about one and one-half teaspoons, and a nipple that stretches over the mouth of the bottle. This, however, might cause a less than effective seal to be formed between the nipple and the small bottle or vial, resulting in spilling or dripping of the medicament. Moreover, it maybe difficult for a mother or other caregiver to stretch the nipple over the bottle without spilling the medicament, particularly if he or she is carrying or watching the infant at the same time. In addition, the bottle is small enough for an infant to swallow if not carefully watched.

Roskilly involves a rather complicated assembly that fits on top of a bottle and includes a nipple, a passageway defined between the bottle and the nipple, and a syringe assembly for injecting medicament into the stream of liquid coming out of the bottle to dispense the medicament to an infant. While this may be effective, it is rather complicated, expensive to manufacture, and difficult to clean.

Urban involves a medicinal container having the general shape of a nipple that is constructed to define a chamber that serves as reservoir for a liquid, semi-solid or solid medicament and protects the medicament from the outside environment. It includes a plug that, upon being pulled out of the nipple, will permit an infant to remove the medicament from the nipple by sucking. This arrangement is rather complicated, and is not meant to dispense a liquid medicament that is already stored in another container, such as a medicine bottle.

The Roth patent discloses a medicine dispenser insert for nursing bottles that involves a vial that is shaped to be inserted into a cylindrical bore area of a nipple. This, like the Mitchell system, would be rather difficult to use in practice, and might result in dripping or spilling of the medicament.

One problem with all of the systems discussed above is that an infant is likely to be wary of any medicine dispensing assembly that appears unusual.

It is clear that there has existed long and unfilled need in the art for a system for dispensing liquid medicine to an infant that is effective, accurate, inexpensive and compatible with most of the baby bottles that are commercially available today.

SUMMARY OF THE INVENTION

Accordingly, it is an object of the invention to provided an improved system and method for dispensing liquid medicaments to infants that is effective, accurate, inexpensive and compatible with most of the baby bottles that are commercially available today.

In order to achieve the above and other objects of the invention, a system for dispensing liquid medicine to an infant includes, according to a first aspect of the invention, a baby bottle, the baby bottle having a threaded neck portion at an upper end thereof, the threaded neck portion having a rim that defines an opening therein; a resilient nipple member; a ring member for holding the nipple member tightly against the rim during feedings, the ring member having threads defined in an interior portion thereof that mate with the threaded neck portion, whereby the ring member may be screwed onto the bottle; and a medicine cup, the medicine cup including a concave cup-like portion that is sized to fit within the threaded neck portion of the baby bottle, the medicine cup further including a flange for supporting the medicine cup on the rim of the baby bottle, the flange being sized so as not to interfere with the ring member during screwing and unscrewing of the ring member onto the baby bottle, the cup-like portion being constructed so as to be impervious to fluid transfer therethrough so that medicine will not leak from the medicine cup into the baby bottle, whereby medicine may be dispensed to an infant by filling the medicine cup with medicine, setting the medicine cup into the threaded neck portion of the baby bottle, and screwing the ring member, together with the nipple member, onto the threaded neck portion so as to seal the nipple member into communication with the medicine cup and out of communication with the rest of the baby bottle.

According to a second aspect of the invention, a medicine cup for use in a baby bottle system of the type having a baby bottle with a threaded neck portion with a rim that defines an opening therein, a resilient nipple member and a ring member for holding the nipple member tightly against the rim during feedings includes a concave cup-like portion that is sized to fit within a threaded neck portion of a baby bottle; a flange for supporting the medicine cup on a rim of the baby bottle, the flange being sized so as not to interfere with the ring member during screwing and unscrewing of a ring member onto the baby bottle; the cup-like portion being constructed so as to be impervious to fluid transfer therethrough so that medicine will not leak from the medicine cup into the baby bottle, whereby medicine may be dispensed to an infant by filling the medicine cup with medicine, setting the medicine cup into the threaded neck portion of the baby bottle, and screwing the ring member, together with the nipple member, onto the threaded neck portion so as to seal the nipple member into communication with the medicine cup and out of communication with the rest of the baby bottle.

According to a third aspect of the invention, a method of dispensing a liquid medicament to an infant, includes steps of (a) pouring a predetermined amount of the liquid medicament into a medicine cup that has a concave cup-like portion and a flange portion; (b) inserting the medicine cup into an open mouth of a baby bottle so that the concave cup-like portion is positioned within the bottle while the flange portion rests on an upper rim of the bottle; (c) screwing a ring member with an attached nipple member onto the baby bottle to form a medicament dispensing assembly so that the nipple member seals against the medicine cup to communicate the nipple member with the medicine cup and to discommunicate the nipple member from the rest of the baby bottle; and (d) presenting the medicament dispensing assembly to an infant so that the infant can ingest the medicament.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 1 is a exploded cross-sectional view of a system for dispensing liquid medicine to an infant that is constructed according to a preferred embodiment of the invention.

DETAILED DESCRIPTION OF THE PREFERRED EMBODIMENT

Referring now to FIG. 1, a system 10 for dispensing liquid medicine to an infant includes a baby bottle 12, a nipple member 14 and a ring member 16. As is common in this area of technology, baby bottle 12 has a threaded neck portion 18 at an upper end 28 thereof that terminates in an annular rim 20 that defines an open mouth of the baby bottle 12.

Resilient nipple member 14 is preferably fabricated from a material such as silicone, latex or vinyls, and includes a nursing portion 22 that is designed to fit in an infant's mouth, and a sealing gasket portion 24 that is unitary with nursing portion 22, and is seated within an upper internal portion of the ring member 16, as is well known to those in this industry, mothers and caregivers alike. A lower surface of sealing gasket portion 24 is designed, during ordinary feeding with baby bottle 12, to seat securely against the rim 20 of baby bottle 12 in order to ensure that milk or other liquids do not leak from the baby bottle 12 when the bottle is inverted and the baby is feeding. Ring member 16 has a number of internal threads 26 that are constructed and arranged to mate with threads on the threaded neck portion 18 of baby bottle 12.

According to one important aspect of the invention, a medicine cup 30 having a concave cup-like portion 32 and a flange portion 34 is sized and adapted to fit within the system 10 so that the concave cup-like portion 32 will fit within the threaded neck portion 18 of bottle 12, and the flange portion 34 will support the medicine cup 30 on the upper rim 20 of the baby bottle 12. In the preferred embodiment, flange portion 34 is unitary with cup-like portion 32, and both cup-like portion 32 and flange portion 34 are fabricated from a hard plastic material that is boilable such as polycarbonate. Preferably, the material from which medicine cup 30 is fabricated is substantially transparent, so that a user will be easily able to determine the amount of medicine that is in the medicine cup 30. Moreover, medicine cup 30 preferably has measuring indicia 36 printed or embossed thereon to help a caregiver determine the amount of medicine that is contained within the medicine cup 30.

Flange portion 34 is sized so as not to interfere with ring member 16 during screwing and unscrewing of ring member 16 onto the threaded neck portion 18 of baby bottle 12. Flange portion 34 preferably extends around the entire circumference of rim 20, although, in an alternative embodiment, it could extend only partially, but not completely, about the rim 20. Concave cup-like portion 34 is sized so as to snugly fit within the upper rim 20 of baby bottle 12 so as to seat securely within the opening of bottle 12.

In operation, the system 10 is disassembled, and a caregiver will pour a predetermined amount of liquid medicament into medicine cup 30, comparing the intended amount of liquid with the measured amount of liquid that is indicated by indicia 36. The medicine cup is than inserted into the open mouth of baby bottle 12, in the orientation that is depicted in FIG. 1. Flange portion 34 of the medicine cup 30 is set down upon the upper rim 20 of bottle 12, and ring member 16 having the resilient nipple member 14 already mounted therein is screwed securely onto the threaded neck portion 18 of the baby bottle 12. At this point, the lower surface of the sealing gasket portion 24 of nipple member 14 will be sealed securely against the flange portion 34 of medicine cup 30. This will communicate the nursing portion 22 of nipple member 14 with the medicine cup 30, and discommunicate it from the rest of baby bottle 12. At this point, the infant is given the assembled system 10 as if a normal feeding were taking place. The infant will ingest the medicine. After the infant has ingested the medicine, the system 10 can be disassembled by unscrewing ring member 16 from the threaded neck portion 18 of baby bottle 12, and removing the medicine cup 30 from the bottle 12. The bottle 12, the ring member 16 and the nipple member 14 may then be reassembled for use in an ordinary feeding either immediately or a short-time after the dispensation of the medicament to the infant.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A system for dispensing liquid medicine to an infant, comprising:

a baby bottle, said baby bottle having a threaded neck portion at an upper end thereof, said the threaded neck portion having a rim that defines an opening therein;

a resilient nipple member;

a ring member holding said nipple member tightly against said rim during feedings, said ring member having threads defined in an interior portion thereof that mate with said threaded neck portion, whereby said ring member is screwed onto said bottle; and a medicine cup, said medicine cup comprising a fluid impervious concave cup-like portion that is fitted within said threaded neck portion of said baby bottle so as to communicate with said nipple member but not the rest of said baby bottle, said medicine cup further comprising flange means for supporting said medicine cup on said rim of said baby bottle, said flange means being sized so as not to interfere with said ring member during screwing and unscrewing of said ring member onto said baby bottle, said cup-like portion being constructed so as to be impervious to fluid transfer therethrough so that medicine will not leak from said medicine cup into said baby bottle, whereby medicine may be dispensed to an infant by filling the medicine cup with medicine, setting the medicine cup into the threaded neck portion of the baby bottle, and screwing the ring member, together with the nipple member, onto the threaded neck portion so as to seal said nipple member into communication with said medicine cup and out of communication with the rest of said baby bottle.

2. A system according to claim 1, wherein said flange means is unitary with said cup portion.

3. A system according to claim 1, wherein said cup portion is fabricated from a substantially transparent material, whereby a user will be easily able to determine an amount of medicine that is in said medicine cup.

4. A system according to claim 3, wherein said cup portion has indicia printed thereon to indicate an amount of medicine contained therein.

5. A system according to claim 1, wherein said cup portion has indicia printed thereon to indicate an amount of medicine contained therein.

6. A system according to claim 1, wherein said medicine cup is fabricated from polycarbonate.

* * * * *